US011166502B2

(12) United States Patent
Hull

(10) Patent No.: US 11,166,502 B2
(45) **Date of Patent: *Nov. 9, 2021**

(54) PROTECTIVE DEVICE FOR USE WITH A GLOVE

(71) Applicant: Summit Glove Inc., Minerva, OH (US)

(72) Inventor: James L Hull, Malvern, OH (US)

(73) Assignee: Summit Glove Inc., Minerva, OH (US)

( * ) Notice: Subject to any disclaimer, the term of this patent is extended or adjusted under 35 U.S.C. 154(b) by 114 days.

This patent is subject to a terminal disclaimer.

(21) Appl. No.: 16/724,767

(22) Filed: Dec. 23, 2019

(65) Prior Publication Data

US 2020/0121009 A1 Apr. 23, 2020

Related U.S. Application Data

(60) Division of application No. 15/384,499, filed on Dec. 20, 2016, which is a continuation of application No. 14/624,047, filed on Feb. 17, 2015, now Pat. No. 9,888,733, which is a continuation-in-part of application No. 13/947,423, filed on Jul. 22, 2013, now abandoned.

(51) Int. Cl.
*A41D 19/015* (2006.01)
*A41D 13/08* (2006.01)

(52) U.S. Cl.
CPC ..... *A41D 19/01505* (2013.01); *A41D 13/081* (2013.01); *A41D 19/01529* (2013.01); *A41D 19/01594* (2013.01); *A41D 2600/20* (2013.01)

(58) Field of Classification Search
CPC ..... A41D 19/01505; A41D 13/081; A41D 19/01529; A41D 19/01594; A41D 19/01511; A41D 13/082
USPC ..... 2/16
See application file for complete search history.

(56) References Cited

U.S. PATENT DOCUMENTS

| | | | |
|---|---|---|---|
| 1,483,595 | A | 2/1924 | Read |
| 1,625,999 | A | 4/1927 | Irish |
| 1,673,517 | A | 6/1928 | Kurz |
| 2,001,961 | A | 5/1935 | Jensen |
| 2,040,137 | A | 5/1936 | Jensen |
| 2,041,201 | A | 5/1936 | Neback |
| 2,067,790 | A | 1/1937 | Sager |
| 2,067,791 | A | 1/1937 | Sager |
| 2,114,022 | A | 4/1938 | Jensen |
| 2,142,788 | A | 1/1939 | Jensen |
| 2,582,240 | A | 1/1952 | Dumas |
| 2,849,786 | A | 9/1958 | Ashley et al. |
| 2,905,946 | A | 9/1959 | Goldsmith |
| 2,988,457 | A | 6/1961 | Gatcomb |
| 3,267,486 | A | 8/1966 | Madnick |
| 3,633,216 | A | 1/1972 | Schonholtz |
| 3,997,922 | A | 12/1976 | Huhta |
| 4,001,895 | A | 1/1977 | Cohen |

(Continued)

*Primary Examiner* — Alissa L Hoey
(74) *Attorney, Agent, or Firm* — Sand, Sebolt & Wernow Co., LPA

(57) ABSTRACT

A protective device for use in a high temperature and liquid environment provides a glove integrally formed with a protective member in the thumb webbing region. The protective member is not readily detectable when viewing the outside of the glove. The protective member is cut resistant and constructed to protect a workman's hand as a sharp and hot object passes over the protective member contacting the outer surface of the glove.

13 Claims, 8 Drawing Sheets

(56) References Cited

U.S. PATENT DOCUMENTS 4,032,990 A 7/1977 Mandlman
4,061,709 A 12/1977 Miller et al.
4,172,293 A 10/1979 Vistins
4,295,229 A 10/1981 Clark et al.
4,433,439 A 2/1984 Sidman et al.
4,454,611 A 6/1984 Tschirch et al.
4,524,464 A 6/1985 Primiano et al.
4,589,233 A 5/1986 Parekh
4,658,441 A 4/1987 Smith
4,694,508 A 9/1987 Iriyama et al.
4,696,065 A 9/1987 Elenteny
4,709,694 A * 12/1987 O'Connell ..... A61F 5/10 2/167
4,742,578 A 5/1988 Seid
4,750,218 A 6/1988 Ziegler
4,779,289 A 10/1988 Prouty
4,779,290 A 10/1988 Welch et al.
4,785,479 A 11/1988 Watanabe
4,833,733 A 5/1989 Welch et al.
4,894,866 A 1/1990 Walker
4,910,803 A 3/1990 Cukier
4,942,626 A 7/1990 Stern et al.
4,987,611 A 1/1991 Maye
4,995,119 A 2/1991 CodKind
5,020,161 A 6/1991 Lewis, Jr. et al.
5,070,540 A 12/1991 Bettcher et al.
5,083,973 A 1/1992 Townsend
5,093,933 A 3/1992 Berry
5,113,532 A 5/1992 Sutton
5,168,578 A 12/1992 Stanley
5,187,815 A 2/1993 Stern et al.
5,224,363 A 7/1993 Sutton
5,231,700 A 8/1993 Cutshall
5,345,608 A 9/1994 Mergens et al.
5,384,083 A 1/1995 Dawn et al.
5,402,536 A 4/1995 Matthews
5,500,957 A 3/1996 Stein
5,561,856 A * 10/1996 Pesco ..... A41D 19/01588 2/16
5,564,127 A 10/1996 Manne
5,588,651 A 12/1996 Frost
5,598,582 A 2/1997 Andrews et al.
5,604,934 A 2/1997 Willett
5,629,039 A 5/1997 Brintle
5,685,014 A 11/1997 Dapsalmon
D389,608 S 1/1998 Kraatz
5,708,979 A 1/1998 Redwood et al.
5,745,919 A 5/1998 Kraatz
5,758,569 A 6/1998 Barbour
5,770,297 A 6/1998 Grubich
5,822,791 A 10/1998 Baris
5,857,216 A 1/1999 Gold
5,867,830 A 2/1999 Chen
5,937,743 A 8/1999 Overstreet
5,988,048 A 11/1999 Hunter et al.
6,012,170 A 1/2000 Kim
6,021,523 A 2/2000 Vero
6,142,064 A 11/2000 Backus et al.
6,145,128 A 11/2000 Suzuki
6,154,885 A 12/2000 Kobayashi et al.
6,260,203 B1 7/2001 Battle
6,279,166 B1 8/2001 Schild
6,314,869 B1 11/2001 Bourgeois, Jr.
6,330,851 B1 12/2001 Riesselmann
6,341,376 B1 1/2002 Smerdon, Jr.
6,360,373 B1 3/2002 Rehn et al.
6,427,246 B1 8/2002 Doi et al.
6,457,182 B1 10/2002 Szczesuil et al.
6,496,984 B1 * 12/2002 Chow ..... A61F 5/0118 2/16
6,539,552 B1 4/2003 Yoshida
6,651,255 B1 11/2003 Schild
6,711,746 B1 3/2004 Orellana
6,721,960 B1 4/2004 Levesque et al.
6,760,924 B2 7/2004 Hatch et al.
6,871,359 B2 3/2005 Han
6,973,675 B2 12/2005 Cheng
7,021,204 B2 4/2006 Backus et al.
7,062,791 B2 6/2006 Gold
7,089,600 B2 8/2006 Morita
D533,969 S 12/2006 Contant et al.
D537,211 S 2/2007 Contant et al.
7,284,283 B2 10/2007 Mack et al.
7,377,566 B2 5/2008 Gazaui
7,380,288 B1 6/2008 Duncan
7,383,590 B1 6/2008 Duncan
7,431,671 B1 10/2008 Frost
7,469,426 B2 12/2008 Roeckl
7,480,945 B2 1/2009 Knuth et al.
7,725,979 B1 6/2010 Held et al.
D622,030 S 8/2010 Thompson
7,836,839 B2 11/2010 Park
7,873,998 B1 1/2011 Wilkinson et al.
7,963,864 B2 6/2011 Frost
8,104,097 B2 1/2012 Hamann
8,146,173 B2 4/2012 Kim
8,413,469 B2 4/2013 Lapp et al.
8,656,518 B2 2/2014 Saunders et al.
8,733,235 B1 5/2014 Chipman
8,852,033 B1 10/2014 Frost
8,863,316 B2 10/2014 Gaskins
8,863,317 B2 10/2014 Tsuru et al.
9,161,579 B1 10/2015 Johnson
9,198,474 B1 12/2015 Haccobian
9,266,263 B1 2/2016 Jaeger
9,538,797 B2 1/2017 Jones et al.
9,549,579 B2 1/2017 Bailey
9,549,836 B2 * 1/2017 Anglada ..... A61F 5/0118
9,609,900 B2 4/2017 Schild
9,622,524 B2 4/2017 VanErmen et al.
9,888,733 B2 2/2018 Hull
10,111,477 B1 10/2018 Ballas
10,413,003 B2 9/2019 Kimbrough
2002/0042940 A1 4/2002 Kuroda et al.
2003/0005507 A1 1/2003 Litke
2003/0005828 A1 1/2003 McLemore et al.
2003/0079273 A1 5/2003 Genkins
2003/0134063 A1 7/2003 Vance et al.
2003/0140396 A1 7/2003 Vero et al.
2003/0179653 A1 9/2003 McLemore et al.
2004/0187189 A1 9/2004 Morita
2005/0005338 A1 1/2005 Lewis
2005/0028244 A1 2/2005 Roeckl
2005/0056633 A1 3/2005 Backus et al.
2005/0284306 A1 12/2005 Backus et al.
2006/0080757 A1 4/2006 Beyda
2006/0090771 A1 5/2006 Ramet
2006/0150299 A1 7/2006 Geng
2006/0150300 A1 7/2006 Hassan et al.
2007/0083980 A1 4/2007 Yang et al.
2008/0052799 A1 3/2008 Yoo
2008/0081529 A1 4/2008 Gehring
2008/0120754 A1 5/2008 Raymond
2008/0216209 A1 9/2008 Kim
2009/0061204 A1 3/2009 Hssu et al.
2009/0068443 A1 3/2009 Curtet et al.
2009/0077704 A1 3/2009 Duncan et al.
2009/0126074 A1 5/2009 Mattesky
2009/0139011 A1 6/2009 VanErmen et al.
2009/0158486 A1 6/2009 Cote
2009/0271905 A1 11/2009 Alexander
2010/0037364 A1 2/2010 Saunders et al.
2010/0095428 A1 4/2010 Fisher
2010/0186144 A1 7/2010 Zhu
2010/0186457 A1 7/2010 Zhu
2010/0275342 A1 11/2010 Sweeney et al.
2010/0325779 A1 12/2010 Matsunobu et al.
2011/0145967 A1 6/2011 Hull
2011/0185466 A1 8/2011 Hassan et al.
2011/0208321 A1 8/2011 Doddroe et al.
2011/0287553 A1 11/2011 Hassan et al.
2011/0289652 A1 12/2011 Thompson et al.
2012/0030856 A1 2/2012 Bevier
2012/0167778 A1 7/2012 Popeil et al.

(56) References Cited

U.S. PATENT DOCUMENTS

| | | | |
|---|---|---|---|
| 2012/0227158 | A1 | 9/2012 | Ashworth et al. |
| 2012/0278964 | A1 | 11/2012 | Bormann-Early |
| 2013/0061369 | A1 | 3/2013 | Lim |
| 2013/0152262 | A1 | 6/2013 | Bedetti et al. |
| 2013/0180022 | A1 | 7/2013 | Baungartger |
| 2013/0219588 | A1 | 8/2013 | Nakagawa |
| 2013/0254964 | A1 | 10/2013 | Robinson |
| 2013/0319055 | A1 | 12/2013 | Tatsumi et al. |
| 2014/0137304 | A1 | 5/2014 | Katz |
| 2014/0138968 | A1 | 5/2014 | Gentry et al. |
| 2014/0259255 | A1 | 9/2014 | Ragan |
| 2015/0020284 | A1 | 1/2015 | Hull |
| 2015/0121598 | A1 | 5/2015 | Matthews et al. |
| 2015/0143608 | A1 | 5/2015 | Loo et al. |
| 2015/0164159 | A1 | 6/2015 | Hull |
| 2015/0313298 | A1 | 11/2015 | Bailey |
| 2016/0029712 | A1 | 2/2016 | Hull |
| 2016/0192721 | A1 | 7/2016 | Kishihara |
| 2016/0213075 | A1 | 7/2016 | Omer |
| 2016/0235138 | A1 | 8/2016 | Smith |
| 2016/0325173 | A1 | 11/2016 | Leary |
| 2017/0055607 | A1 | 3/2017 | Francisco Costa et al. |
| 2018/0077980 | A1 | 3/2018 | Hull |
| 2018/0103701 | A1 | 4/2018 | Hull |
| 2018/0263418 | A1 | 9/2018 | Hedrington et al. |
| 2019/0014835 | A1 | 1/2019 | Hull |

* cited by examiner

PROTECTIVE DEVICE FOR USE WITH A GLOVE

CLAIM OF PRIORITY

The present application is a divisional application of U.S. patent application Ser. No. 15/384,499, filed Dec. 20, 2016, which is a continuation in part application of U.S. patent application Ser. No. 14/624,047, filed on Feb. 17, 2015, which is a continuation in part application of U.S. patent application Ser. No. 13/947,423, filed on Jul. 22, 2013, and claims priority thereto, the entirety of each is incorporated herein as if fully rewritten.

BACKGROUND OF THE INVENTION

Technical Field

The present invention relates generally to protective coverings. More particularly, the present invention relates to protective coverings used as a glove for a hand. Specifically, the present invention provides a protective device to cover the webbing region located between a thumb and index finger (i.e., the thumb crotch) on a liquid proof heat resistant glove or mitten.

Background Information

Humans have enjoyed roasting chickens on a rotisserie since at least the middle ages. Modern rotisserie devices are provided in the form of ovens, often at supermarkets or grocery stores. The chickens cook on a rotisserie spit that rotates in the oven. The spit is extremely sharp as it has to pierce the chicken so the chicken may be affixed to the spit while it rotates in the oven. The rotisserie oven heats up to high temperatures, often in excess of 500 degrees, and cooks the chicken.

Liquid proof heat resistant gloves are often used in commercial settings, such as delicatessens, that cook their own rotisserie chickens. These gloves are designed to protect a worker's hands from the high heat and hot liquids (e.g., grease) that are associated with the rotisserie roasting of chicken. A deli worker dons these gloves prior to removing the chickens from the spit. To remove a chicken from a spit, a worker wearing the liquid proof heat resistant gloves removes the spit from the rotating oven. The worker then grasps the spit at one end. Ordinarily, a right handed person grasps the right end of the spit with his right hand and grasps adjacent the right end of the spit with his left hand in the glove. The user then pulls the spit using his right hand in a motion similar to drawing a sword, all while continuing to grasp the spit with his left hand. As the spit travels through the user's grasped hand, the chickens are released from the spit and fall into a desired container. A problem often arises when the worker removes the chickens because drawing the spit through the grasped glove has a tendency to cut the glove surface. The liquid proof heat resistant gloves often cost around one hundred dollars a pair and currently some delicatessens are replacing cut or damaged gloves every three days.

A search for prior art revealed a protector for a ski glove. One exemplary ski glove protector is manufactured by Kombi, Ltd. of Essex Junction, Vermont, USA and sold commercially under the name of "Glove Protector" available at www.skis.com. This Kombi glove protector is constructed of natural leather and is for use with ski gloves to protect a cold weather ski glove from being torn by ski tow ropes while a wearer grasps the tow rope. This Kombi glove protector is for cold weather outdoor gear and would not function in a protective manner at the high temperatures required for protecting a liquid proof heat resistant glove donned by a deli worker. The leather constructed Kombi glove would melt at the high temperature ranges in which the present invention operates.

Additionally, other protective devices used on gloves have been shown in the prior art. For example, U.S. Pat. No. 7,089,600 (the '600 patent) discloses a work glove including a fiber-made base glove with two reinforcement coats. A first reinforcement coat of compound rubber latex (essentially neoprene) extends over the crotch between the thumb and forefinger. A second reinforcement coat of compound rubber latex covers the fiber-made base glove except a back thereof includes the first reinforcement coat. Essentially, the first reinforcement coat is not covered by the second reinforcement coat on the back portion (i.e., dorsal portion or volar portion) of the glove. The first reinforcement coat and the second reinforcement coat extend along the length of the forefinger and cover the distal tip thereof. Thumb implementations of compound rubber latex may increase the stiffness of the base glove thereby reducing finger flexion or increasing finger strain and muscle strength to effectuate a similar flexion of a base glove free of the first and second reinforcement layers. Thus, while the crotch region may be covered with the first and second reinforcement layers, other drawbacks may continue to exist.

An additional attempt at protecting a portion of the hand is detailed in U.S. Pat. No. 4,873,998 (the '998 patent). The '998 patent provides a hardened plastic band formed from a thermos-plastic material that allows enough flexibility to move the hand, but also has a substantial density to protect the same. One drawback associated with the protective device of the '998 patent is that it likely could not be used in high-heat environments inasmuch as portions of the hand are exposed through the protective band.

An additional attempt at protecting the thumb-crotch region of the hand is detailed in U.S. P.G. Publication 2003/0140396 (the '396 publication). The '396 publication details a unilayer flexible textile performance fabric comprising a base fabric having at least one dissimilar high performance fiber interwoven into said base fabric. The '396 publication details that the weaving of the two distinct fibers together creates a single layer of material. The high performance fiber may be cut-resistant.

SUMMARY

Thus, while the liquid proof heat resistant gloves exist for protecting the deli worker from the hot spit and hot liquids, a need exists to protect the expensive glove from the slicing motion of the spit as it pulled through the grasped hand of the deli worker.

In one aspect, an embodiment of the present disclosure may provide a protective device for use in a high temperature and liquid environment provides a glove integrally formed with a protective member in the thumb webbing region. The protective member is not readily detectable when viewing the outside of the glove. The protective member is cut resistant and constructed to protect a worker's hand as a sharp and hot object passes over the protective member contacting the outer surface of the glove In another aspect, an embodiment of the present disclosure may provide a protective member for a thumb-crotch region of the glove that, prior to installing on a glove, is laid flat and the protective member comprises: a generally rounded trapezoidal-shaped edge bounding a first surface opposite a second surface; a major axis associated with the generally rounded trapezoidal-shaped edge; a minor axis associated with the generally rounded trapezoidal-shaped edge; at least two opposing slits interrupting the generally rounded trapezoidal-shaped edge, wherein the at least two slits extend parallel to the minor axis and each terminates prior to the major axis, wherein the two slits are enable the protective member to bend around a thumb region of the glove and a forefinger region of the glove such that the major axis extends over thumb-crotch region of the glove.

In yet another aspect, an embodiment of the present disclosure may provide a protective member for a thumb-crotch region of a glove comprising: a first surface facing towards a hand when donning the glove; a second surface opposite the first surface facing away from the hand when donning the glove; an edge bounding the first surface and the second surface; a major axis and a minor axis associated with the first surface, wherein the first surface is longer along the major axis than along the minor axis; and at least one slit interrupting the edge and the first surface, the at least one slit extending generally parallel the to the minor axis; wherein the at least one slit enables the protective member to bend around one of (a) a thumb and (b) a forefinger such that the protective member extends over and protects the thumb-crotch region.

In yet another aspect, an embodiment of the present disclosure may provide a system for protecting an operator from a sharp object moving above a thumb-crotch region comprising: a hand from an operator including at least the following bones: a first metacarpal bone, a second carpal bone, and a third metacarpal bone; a glove donned by the hand; a protective member attached to the glove spanning the thumb-crotch region; and a first edge of the protective member crossing over the second metacarpal bone at an angle in a range from 15° to 75°. This system may further comprises a second edge of the protective member crossing over the second metacarpal bone at an angle generally orthogonal to the first edge of the protective member. The system may further comprise a third edge of the protective member generally parallel with the second edge such that the protective member is generally shaped like a trapezoid when laid flat. The system may further comprise a terminal corner of the first edge positioned approximately directly above the third metacarpal bone. The system may further provide that the protective member defines two slits to enable the protective member to bend around a thumb region of the glove and around a forefinger region of the glove such that the major axis extends over the thumb-crotch region defined between the thumb region and the forefinger region.

In another aspect, an exemplary embodiment of the present disclosure may provide a liquid proof heat resistance glove comprising: an inner liner formed in the shape of a glove having a thumb sleeve, a first finger sleeve, a palmar side, and a dorsal side; an outer layer formed from liquid proof heat resistant material, wherein the outer layer is exterior and entirely covers the thumb sleeve, the first finger sleeve, the palmar side, and the dorsal side, and the outer layer withstanding thermal deformation up to at least 500° F.; a protected region including a forefinger boundary edge that extends along a portion of the first finger sleeve and extends about 180° around a longitudinal axis associated with the first finger sleeve, and the protected region including a thumb boundary edge that extends along a portion of the thumb sleeve and extends about 180° around a longitudinal axis associated with the thumb sleeve, and a palmar boundary edge extending along the palmar side between forefinger boundary edge and the thumb boundary edge, and a dorsal boundary edge extending along the dorsal side between the forefinger boundary edge and the thumb boundary edge; a thumb-crotch region of the glove within the protected region and located between the first finger sleeve and the thumb sleeve, and the thumb crotch region extending from the palmar side to the dorsal side between the first finger sleeve and the thumb sleeve; a protective member positioned between and connected to the inner liner and the outer layer located in the protected region and covering the thumb crotch region and not located in other regions of the glove, wherein the protective member includes: a first portion of the protective member including: a first surface connected to the inner liner; a second surface opposite the first surface connected to the outer layer of the glove; a perimeter edge bounding the first surface and the second surface; a major axis and a minor axis associated with the first surface, wherein the first surface is longer along the major axis than along the minor axis; and at least one slit interrupting the edge and the first surface, the at least one slit extending generally parallel the to the minor axis; wherein the at least one slit enables the protective member to bend around one of (a) the thumb sleeve and (b) the first finger sleeve such that the protective member extends over and protects the thumb-crotch region; wherein the first portion is bent to cover the protected region adjacent an inner terminal end of the at least one slit and a first surface of the liner offset to one side of the slit that faces the first surface on another other side of the slit; wherein the liquid proof heat resistant glove is adapted to be donned and permit a rotisserie spit to pulled in slicing motion along an outer surface of the glove and the outer layer and protective member are configured to protect against high temperatures, hot liquids, and sharp objects. This exemplary embodiment or another exemplary embodiment may further provide wherein the protective member includes: wherein the perimeter edge that is longitudinally aligned relative to the major axis; wherein the at least one slit is aligned substantially parallel to the minor axis; a terminal end of the at least one slit terminating prior to the major axis; a length of the slit measured from the edge to the terminal end of the at least one slit, wherein the length is in a range from about ½ inch to about 3 inches. This exemplary embodiment or another exemplary embodiment may further provide wherein the protective member includes: a second portion that is a first quarter-round shaped member having an arcuate edge, and two perpendicular edges meeting at a point. This exemplary embodiment or another exemplary embodiment may further provide wherein the protective member includes: a first slit edge and a second slit edge on the first portion that move to increase a space between the first slit edge and second slit edge; wherein the first quarter-round shaped member is disposed within the space between the first slit edge and the second slit edge on the first portion such that the point of the first quarter-round shaped member is closely adjacent the terminal end of the at least one slit. This exemplary embodiment or another exemplary embodiment may further provide wherein the protective member includes: wherein a union is defined by one of the two perpendicular edges of the quarter-round shaped member with a portion of a first slit edge and the first slit edge defining a portion of the at least one slit. This exemplary embodiment or another exemplary embodiment may further provide wherein the protective member includes: a second slit on the first portion that is coplanar with the first slit and opposite the at least one slit relative to the major axis, and a terminal end of the second slit terminating the same distance prior to major axis as the first slit. This exemplary embodiment or another exemplary embodiment may further provide wherein the protective member includes: a second portion that is a first quarter-round shaped member having an arcuate edge, and two perpendicular edges meeting at a point, wherein the first quarter-round shaped member is disposed within the at least one slit between a first slit edge and a second slit edge of the at least one slit; and a third portion that is a second quarter-round shaped member having an arcuate edge, and two perpendicular edges meeting at a point, wherein the second quarter-round shaped member is disposed within the second slit between a first slit edge and a second slit edge of the second slit. This exemplary embodiment or another exemplary embodiment may further provide wherein the perimeter edge of protective member includes: a first edge spaced apart and parallel to a second edge; a third edge extending between the first edge and the second edge; a fourth edge opposite and spaced apart from the third edge and extends between the first edge and the second edge. This exemplary embodiment or another exemplary embodiment may further provide wherein the protective member further includes: a rounded first corner, wherein the third edge meets the first edge at the rounded first corner. This exemplary embodiment or another exemplary embodiment may further provide wherein the protective member further includes: a rounded second corner, wherein the third edge meets the second edge at the rounded second corner. This exemplary embodiment or another exemplary embodiment may further provide wherein the protective member further includes: a rounded third corner, wherein the fourth edge meets the first edge at the rounded third corner. This exemplary embodiment or another exemplary embodiment may further provide wherein the protective member further includes: a rounded fourth corner, wherein the fourth edge meets the second edge at the rounded fourth corner. This exemplary embodiment or another exemplary embodiment may further provide wherein the protective member further includes: wherein the third edge extends ulnarly between the first edge and the second edge at an angle between 15° and 75° relative to the longitudinal axis of the glove. This exemplary embodiment or another exemplary embodiment may further provide wherein the protective member further includes: wherein the third edge extends perpendicular to the major axis of the protective member and parallel to the minor axis of the protective member. This exemplary embodiment or another exemplary embodiment may further provide wherein the protective member further includes: wherein the fourth edge extends distally above a longitudinal axis of the thumb sleeve. This exemplary embodiment or another exemplary embodiment may further provide wherein the protective member further includes: wherein the first edge extends radially at an angle generally orthogonal to that of the third edge.

In yet another aspect, an exemplary embodiment of the present disclosure may provide A liquid proof heat resistance glove comprising: an inner liner formed in the shape of a glove having a thumb sleeve, a first finger sleeve, a palmar side, and a dorsal side; an outer layer formed from liquid proof heat resistant material, wherein the outer layer is exterior and entirely covers the thumb sleeve, the first finger sleeve, the palmar side, and the dorsal side, and the outer layer withstanding thermal deformation up to at least 500° F.; a protected region including a forefinger boundary edge that extends along a portion of the first finger sleeve and extends about 180° around a longitudinal axis associated with the first finger sleeve, and the protected region including a thumb boundary edge that extends along a portion of the thumb sleeve and extends about 180° around a longitudinal axis associated with the thumb sleeve, and a palmar boundary edge extending along the palmar side between forefinger boundary edge and the thumb boundary edge, and a dorsal boundary edge extending along the dorsal side between the forefinger boundary edge and the thumb boundary edge; a thumb-crotch region of the glove within the protected region and located between the first finger sleeve and the thumb sleeve, and the thumb crotch region extending from the palmar side to the dorsal side between the first finger sleeve and the thumb sleeve; a protective member positioned between and connected to the inner liner and the outer layer located in the protected region and covering the thumb crotch region and not located in other regions of the glove, wherein the protective member includes: a first portion of the protective member including: a first surface connected to the inner liner a second surface opposite the first surface connected to the outer layer of the glove; a perimeter edge having a first edge spaced apart from a second edge, a third edge extending between the first edge and the second edge, a fourth edge opposite and spaced apart from the third edge and extends between the first edge and the second edge, wherein the first, second, third, and fourth edges bound the first surface and the second surface; wherein the third edge extends ulnarly between the first edge and the second edge at an angle between 15° and 75° relative to the longitudinal axis of the glove; wherein the third edge extends perpendicular to the major axis of the protective member and parallel to the minor axis of the protective member; wherein the fourth edge extends distally above a longitudinal axis of the thumb sleeve; wherein the first edge extends radially at an angle generally orthogonal to that of the third edge; a rounded first corner, wherein the third edge meets the first edge at the rounded first corner; a rounded second corner, wherein the third edge meets the second edge at the rounded second corner; a rounded third corner, wherein the fourth edge meets the first edge at the rounded third corner; and a rounded fourth corner, wherein the fourth edge meets the second edge at the rounded fourth corner; a major axis and a minor axis associated with the first surface, wherein the first surface is longer along the major axis than along the minor axis; and a first slit interrupting the first edge and the first surface, the first slit extending parallel the to the minor axis; wherein the first slit enables the protective member to bend around the first finger sleeve such that the protective member extends over and protects the thumb-crotch region; a second slit interrupting the second edge and the first surface, the second slit extending parallel the to the minor axis; wherein the second slit enables the protective member to bend around the thumb sleeve such that the protective member extends over and protects the thumb-crotch region; wherein the perimeter edge is longitudinally aligned relative to the major axis; inner terminal ends of the first and second slits terminating prior to the major axis; similar lengths of the first and second slits measured from an outer end to the terminal end, wherein the similar length of the first and second slits is in a range from about ½ inch to about 3 inches; wherein the first portion is bent to cover the protected region adjacent an inner terminal end of the first slit and a first surface of the liner offset to one side of the first and second slits that faces the first surface on another other side of the first and second slits; wherein the protective member further includes: a second portion that is a first quarter-round shaped member having an arcuate edge, and two perpendicular edges meeting at a point, wherein the first quarter-round shaped member is disposed within the first slit between a first slit edge and a second slit edge of the first slit;

a third portion that is a second quarter-round shaped member having an arcuate edge, and two perpendicular edges meeting at a point, wherein the second quarter-round shaped member is disposed within the second slit between a first slit edge and a second slit edge of the second slit; and wherein the liquid proof heat resistant glove is adapted to be donned and permit a rotisserie spit to pulled in slicing motion along an outer surface of the glove and the outer layer and protective member are configured to protect against high temperatures, hot liquids, and sharp objects.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Initially, the Inventors note that the present disclosure is a continuation-in-part application of U.S. patent application Ser. No. 14/624,047 (the '047 Disclosure) filed on Feb. 17, 2015, the entirety of which is incorporated herein as if fully re-written. The present disclosure touches upon additional subject matter to the aforementioned '047 Disclosure, namely, liquid proof and heat resistant gloves that include integrally formed protective members in, on, along, or extending over the thumb crotch or thumb webbing region of the glove. Since this is a continuation-in-part application of the '047 Disclosure, some similar structural nomenclature is used herein when referencing some portions of the glove. However, there may be some instances where structural nomenclature differs between similar elements and there may be other instances where nomenclature is similar between distinct elements relative to this application and the '047 Disclosure.

A protective member for protecting the thumb crotch region of a liquid proof and heat resistant glove is shown generally throughout FIG. 1 through FIG. 7B at 10. Protective member 10 may include a first portion 12, a second portion 14, and a third portion 16. As will be described in greater detail below, first portion 12, second portion 14, and third portion 16 are connected together to define a unique shape of protective member 10 to cover the thumb crotch region of a liquid proof and heat resistant glove. However, it is to be understood that protective member 10 may be formed as a unibody monolithic member and the regions described herein are to be understood as descriptive of locations relative to other portions of the protective device and are not necessarily independent structures.

Figure 1:
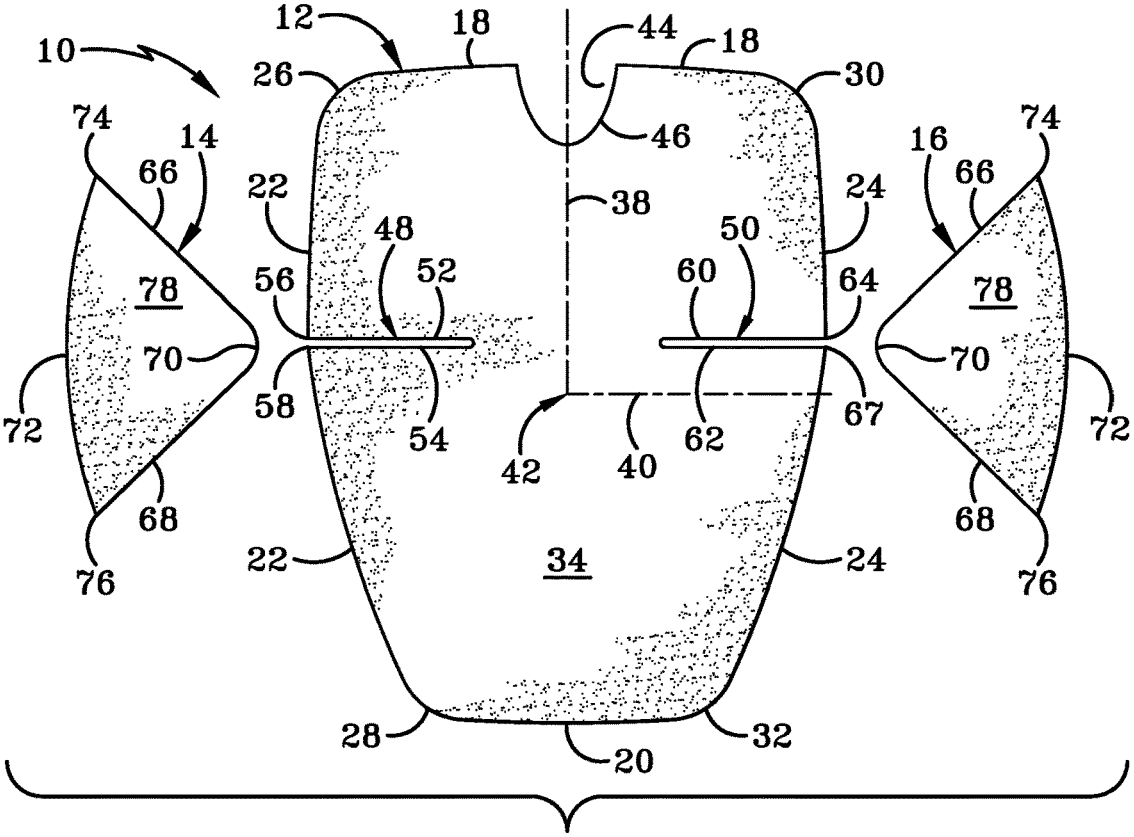
FIG. 1 is an exploded top view of components that define a protective member for use with a liquid proof and heat resistant glove.

FIG. 1 depicts an exploded top view of the first portion 12, the second portion 14, and the third portion 16 laid flat and separated from each other. When laid flat, the first portion 12 is generally trapezoidal in shape having rounded corners. In this embodiment, the first portion 12 may include a first edge 18 spaced apart and generally parallel to a second edge 20. First portion 12 may further include a third edge 22 extending between first edge 18 and second edge 20. First portion 12 may further include a fourth edge 24 that is opposite and spaced apart from third edge 22 and extends between first edge 18 and second edge 20. The third edge 22 meets the first edge 18 at a rounded first corner 26. Additionally, third edge 22 meets the second edge 20 at a rounded second corner 28. The fourth edge 24 meets the first edge 18 at a rounded third corner 30. Additionally, the fourth edge 24 meets the second edge 20 at a rounded fourth corner 32. The aforementioned edges and corners bound an upwardly facing top surface 34 and a downwardly facing bottom surface 36.

FIG. 1 further depicts an imaginary longitudinal axis 38 (i.e., the major axis) perpendicularly intersecting an imaginary transverse axis 40 (i.e., the minor axis). The center 42 of first portion 12 is located where the longitudinal axis 38 intersects the transverse axis 40.

The first portion 12 defines an arcuate cutout region 44 by an arcuately concave edge 46 interrupting first edge 18. In one particular embodiment, the arcuately extending concave edge 46 intersects the imaginary longitudinal axis 38. However, in other embodiments, edge 46 may be located at other portions of first edge 18 to define a cutout region 44. Moreover, in another embodiment, the base, or lowermost portion of concave edge 46, which is closest to transverse axis 40, may intersect longitudinal axis 38.

First portion 12 may further define a first slit 48 and a second slit 50. The first slit 48 extends towards the longitudinal axis 38 from the third edge 22. The first slit 48 interrupts third edge 22 and is arranged generally parallel with transverse axis 40 when the first portion 12 is laid flat. In one embodiment, first slit 48 may be offset from transverse axis 40. In yet another embodiment, the first slit 48 is offset towards the first edge 18 relative to transverse axis 40. The second slit 50 extends towards the longitudinal axis 38 from the fourth edge 24 and interrupts the same. The second slit 50 is offset generally parallel to the transverse axis 40 and in one embodiment, the first slit 48 and the second slit 50 are coplanar and offset towards the first edge 18 from the transverse axis 40. In some implementations, the first portion 12 may be entirely continuous and uninterrupted for all regions of the first portion 12 offset towards the second edge 20 from the transverse axis 40.

The length of the first slit 48 and the second slit 50 is oriented generally parallel with the transverse axis 40. In one implementation, the length of the first slit 48 is equal to the length of the second slit 50. In this case, the length of the first slit 48 and the second slit 50 may be in a range from about 0.5 inches to about three inches. Moreover, in other implementations, the length of the first slit 48 is close to about 1.5 inches.

The first slit 48 is bound by a first slit first edge 52 and a first slit second edge 54. The first slit first and second edges 52, 54 are spaced apart and extend generally parallel to each other and are oriented generally parallel to the transverse axis 40 when protective member 10 is laid fat. First edge 52 meets edge 22 at a corner 56 that is positioned outwardly relative to the inner terminal end of first slit 48. Similarly, second edge 54 meets edge 22 outwardly from the terminal end of first slit 48 relative to the longitudinal axis 38 at a corner 58.

Second slit 50 is bound by a second slit first edge 60 and second slit second edge 62. The second slit first and second edges 60, 62 extend generally parallel and offset from each other and are also parallel to transverse axis 40. First edge 60 extends transversely from a corner 64 towards the inner terminal end of second slit 50. Corner 64 is located where first edge 60 meets fourth edge 24 of the first portion 12. Second edge 62 extends transversely from a corner 67 inwardly towards an inner terminal end of second slit 50. Corner 67 is located where second edge 62 meets edge 24 of the first portion 12.

Reference is now made to the second portion 14 and the third portion 16 inasmuch as they are similarly shaped. Similar reference numerals are utilized for brevity. Each of the second portion 14 and third portion 16 are shaped generally similar to that of an isosceles triangle when laid flat. A first edge 66 is formed generally at a right angle to edge 68 defining a rounded corner 70. An arcuate edge 72 represents a hypotenuse between edge 66 and edge 68 relative to the rounded corner 70. Edge 66 and edge 68 are generally the same length. The arcuate edge 72 meets edge 66 at a corner 74. The arcuate edge 72 meets edge 68 at corner 76. The collective edges of second portion 14 and third portion 16 bound a first surface 78 which faces an opposite second surface 80. First surface 78 of second portion 14 and third portion 16 faces the same direction as top surface 34 of first portion 12. Second surface 80 of second portion 14 and third portion 16 faces the same direction as the bottom surface 36 of first portion 12. Generally, the second portion 14 may be considered as a first quarter-round shaped member having an arcuate edge, and two perpendicular edges meeting at a point, wherein the first quarter-round shaped member is adapted to be disposed within one slit formed by the first portion 12. Similarly, the third portion 16 may be considered a second quarter-round shaped member having an arcuate edge, and two perpendicular edges meeting at a point, wherein the second quarter-round shaped member is adapted to be disposed within an opposing slit on the first portion 12.

Figure 2:
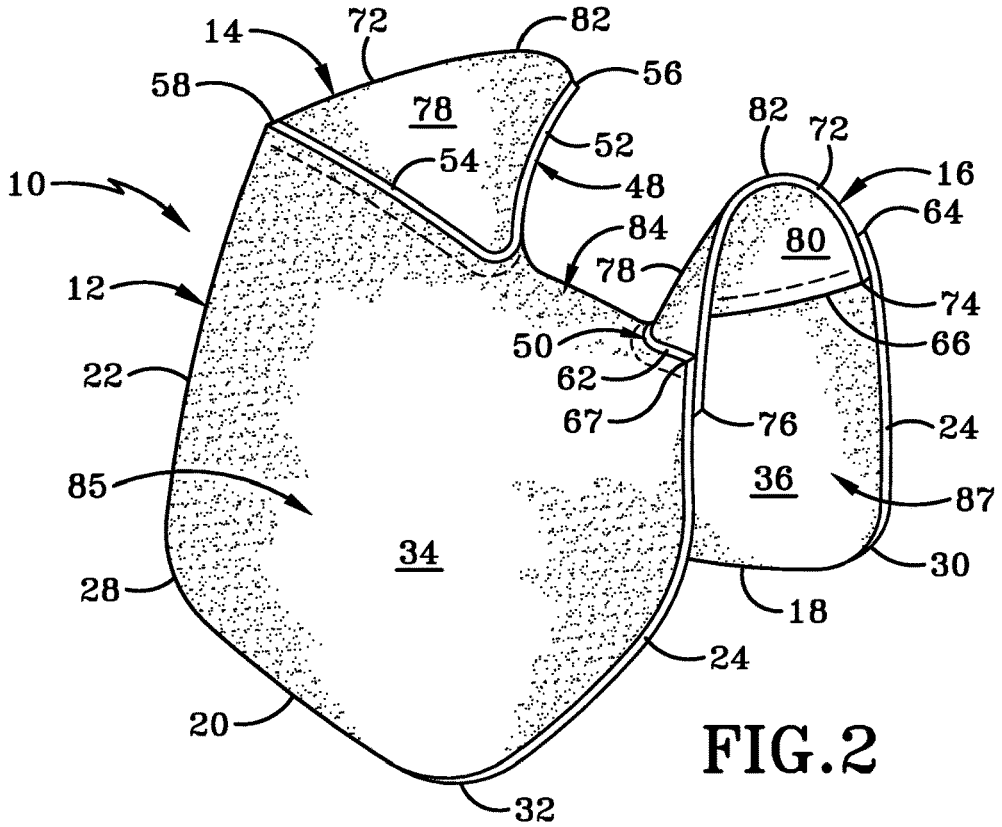
FIG. 2 is an assembled perspective view of the protective member.

FIG. 2 depicts an assembled perspective view of the protective member 10. When assembled, the second portion 14 occupies the space between first slit first edge 52 and first slit second edge 54. The second portion 14 is oriented such that the rounded corner 70 is positioned closely adjacent the inner terminal end of first slit 48. The corners 56, 58 are spread from each other such that corner 56 is aligned proximate corner 74 on second portion 14. Corner 58 is aligned proximate corner 76 on second portion 14. The arcuate edge 72 flexes upwardly and defines an uppermost apex 82. Edge 66 is aligned such that it runs approximately collinearly with edge 52. Edge 68 is aligned such that it runs approximately collinearly with edge 54. The second portion 14 may be joined to the first portion 12 in any manner of known chemical, or mechanical, or non-chemical, and non-mechanical joining methods. Some exemplary mechanical manners of joining the first portion 12 with the second portion 14 include stitching or other sewing techniques. Exemplary chemical manners in which the first portion 12 may be joined to the second portion 14 include adhesive glues or thermal welding.

The third portion 16 is positioned in a similar manner such that it occupies space between second slit first edge 60 and second slit second edge 62. Rounded corner 70 of third portion 16 is positioned proximate the innermost terminal end of second slit 50. Edge 66 is closely aligned with edge 60 and edge 68 is closely aligned with edge 62. Moreover, corner 64 is aligned with corner 74 of third portion 16, and corner 67 is generally proximate corner 76 of third portion 16. Arcuate edge 72 is flexed upwardly to define apex 82 which is at a height similar to that of apex 82 on second portion 14. Inasmuch as the inner terminal ends of the first slit 48 and the second slit 50 are spaced apart, a region 84 is defined on the first portion 12 between second portion 14 and third portion 16. First portion 12 may be folded such that the region 84 is positioned above edge 18 and edge 20 on first portion 12. As will be described in greater detail below, region 84 will extend over the thumb crotch region of a person donning the glove such that the region of first portion 12 offset to one side of region 84 extends over the palmar area of a hand and the opposite region of the first portion 12 and opposite region 84 extends over the dorsal side of a hand.

Figure 3:
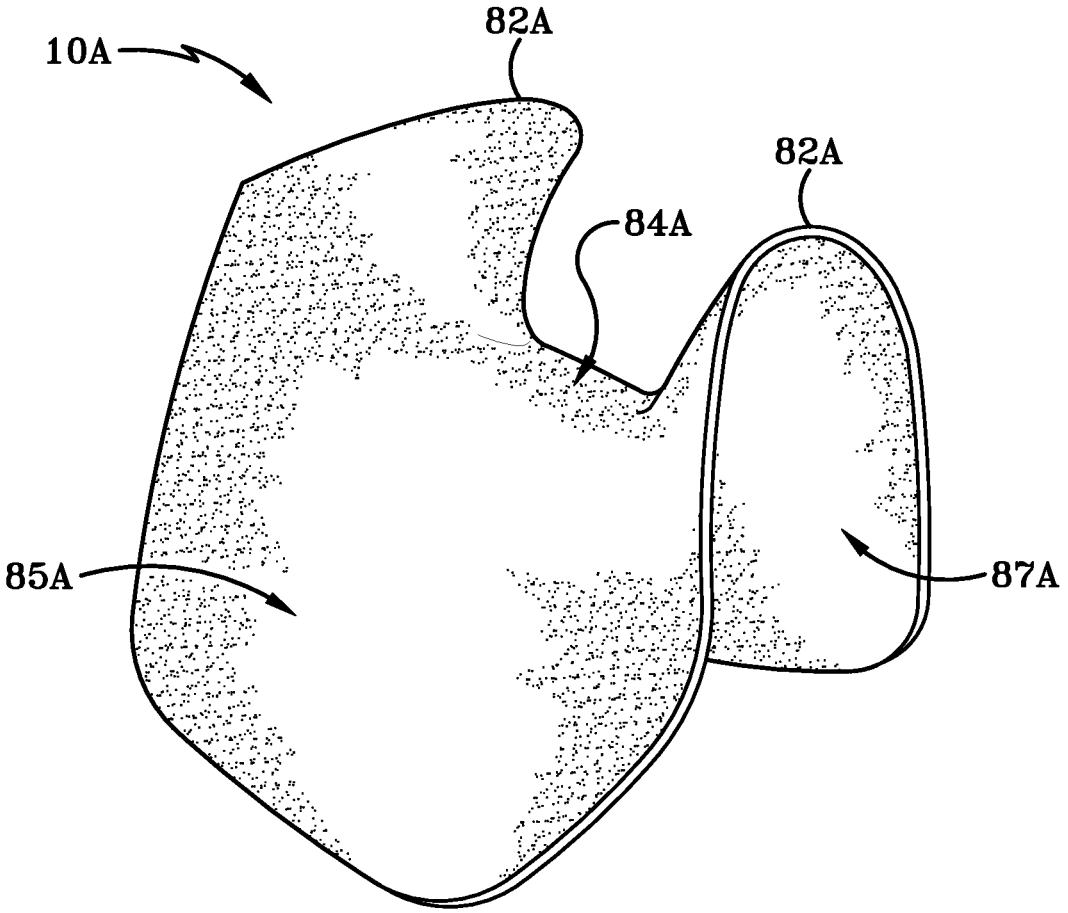
FIG. 3 is a perspective view of an alternative embodiment of the protective member.

FIG. 3 depicts an alternative embodiment of a protective member for use with a liquid proof and heat resistant glove and is shown generally at 10A. Protective member 10A is similar to protective member 10 inasmuch as it fits over the thumb crotch region to protect the person wearing the glove, however it is formed from a monolithic unibody material. Protective member 10A may be molded in a manner such that its shape is similar to the assembled protective member 10 depicted in FIG. 2. Protective member 10A includes a first region 85A that is configured to fit over the palmar region of the wearer's hand when worn. A second region 87A of protective member 10A is configured to lie above the dorsal (or volar) region of a user's hand when donning the glove. In this scenario, the protective region 84A is positioned over the thumb crotch 104 region of the user's hand.

The protective member 10, 10A of the present disclosure can be formed from a variety of materials configured to withstand a sharp object passing over top surface 34 thereof. Protective member 10 or 10A may be formed from a hardened plastic or polymer, however other materials may be utilized. Two alternative materials that may be used to form protective member 10 or 10A are an aramid or a para-aramid synthetic fiber. One exemplary para-aramid material is sold under the name Kevlar® manufactured by the E. I. du Pont de Nemours and Company of Wilmington, Del. A further contemplated alternate material that may be used to form the protective member 10, 10A is chainmail. Protective member 10, 10A is adapted to withstand melting, ignition, and combustion in air at standard reference conditions, at temperatures of at least 500 degrees Fahrenheit, and perhaps able to withstand higher temperatures up to 1000 degrees Fahrenheit.

In accordance with the present disclosure, the protective member 10, 10A is configured to be formed within a glove, as will be described in greater detail below, in order to protect the user who has donned the glove from a hot, sharp, elongated member such as a blade passing over the thumb crotch region of the glove. While it is to be understood that this protective member 10, 10A is integrally molded within the glove such that it is positioned between a liner and an outer surface of liquid proof and heat resistance material (i.e., sandwiched between the inner liner and the outer surface), it is entirely possible for the protective member to be attached externally to the glove as previously described in the parent disclosures from which this disclosure is a continuation in part.

Figure 4:
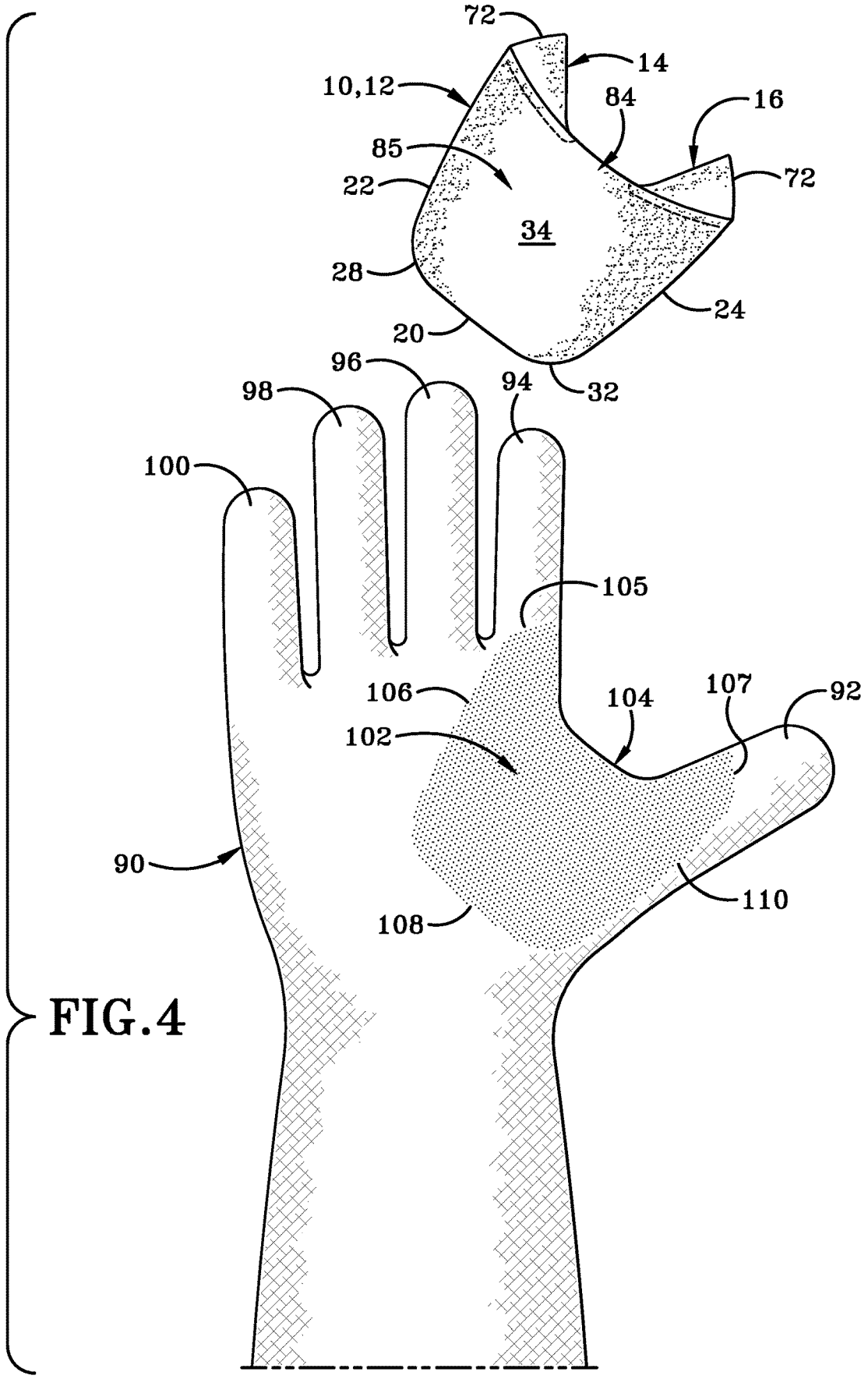
FIG. 4 is an exploded environmental view of the assembled protective member and a liner for a glove detailing the location where the protective member is attached to the liner.

FIG. 4 is an exploded view of the palmar side of a right handed glove liner 90. The liner 90 defines a thumb sleeve 92, an index finger or forefinger sleeve 94, and three other finger sleeves 96, 98, and 100. The liner 90 may be formed of liner material described in the parent disclosures or from another material as one having ordinary skill in the art would understand. One non-limiting exemplary material includes cotton twill, which provides for easy donning and doffing.

The liner 90 defines a region to be protected by the protective member 10, 10A and is shown generally by stippling/shading and identified generally at 102. The region to be protected 102 includes the thumb crotch 104. Region to be protected 102 includes a forefinger boundary edge 105 that extends along a portion of the forefinger sleeve 94 and covers the knuckle joint where the forefinger proximal phalange bone meets the metacarpal bone of the forefinger of the wearer's hand. The forefinger boundary edge 105 extends approximately 180° around the longitudinal axis associated with the forefinger. Additionally, the forefinger boundary edge 105 is disposed between the knuckle joint and the forefinger intermediate phalange bone. Stated otherwise, forefinger boundary edge 105 is positioned proximally relative to the distal tip of the forefinger sleeve 94.

The region to be protected 102 further includes a thumb boundary edge 107 that extends along a portion of the thumb sleeve 92 and covers a portion of the knuckle joint where the proximal thumb phalange bone meets the metacarpal bone of the thumb. The thumb boundary edge 107 extends approximately 180° around the longitudinal axis associated with the thumb. Additionally, the thumb boundary edge 107 is disposed between the knuckle joint and the thumb distal phalange bone. Stated otherwise, thumb boundary edge 107 is positioned proximally relative to the distal tip of the thumb sleeve 92.

The region to be protected 102 extends around and over the thumb crotch 104 such that the region to be protected 102 partially covers a palmar portion and partially covers a dorsal portion of the wearer's hand. With respect to the palmar side, the region to be protect 102 includes a palmar first edge boundary 106, a palmar second edge boundary 108, and a palmar third edge boundary 110.

For the following discussion, some anatomical terms are utilized to identify locations of components of the present disclosure relative to anatomical positions. Components of the present disclosure that are closer to the radius bone of the forearm are referred to herein as "radial" or "radially" relative to other components. Components of the present disclosure that are closer to the ulna bone of the forearm are referred to herein as "ulnar" or "ulnarly" relative to other components.

The palmar first edge boundary 106 extends ulnarly from an angled orientation with the forefinger boundary edge 105. The ulnar-directed extension of the palmar first edge boundary 106 is positioned above the third metacarpal bone (related to the middle finger). The palmar first edge boundary 106 crosses over the third metacarpal bone at an angle between 15° and 75°. In one particular implementation, the palmar first edge boundary 106 crosses over the third metacarpal bone at an angle of about 60° relative to horizontal. The ulnar-directed extension of the palmar first edge boundary 106 terminates proximately above the fourth metacarpal bone (related to the ring finger).

The palmar second edge boundary 108 extends radially from the terminal end of the palmar first edge boundary 106. In one implementation, the palmar second edge boundary 108 meets the palmar first edge boundary 106 at a rounded approximate 90° angle. The radial-directed extension of the palmar second edge boundary 108 is positioned above the third metacarpal bone proximal from the palmar first edge boundary 106. The radial-directed extension of the palmar second edge boundary 108 terminates proximately above the proximal base of the first metacarpal bone (related to the thumb).

The palmar third edge boundary 110 meets the terminal end of the palmar second edge boundary 108 at a rounded approximate 90° angle. The palmar third edge boundary 110 extends distally above the longitudinal axis of the first metacarpal bone. The palmar third edge boundary 110 meets thumb boundary edge 107 above the proximal thumb phalange and proximal relative to the distal thumb phalange.

The aforementioned region to be protected 102 has been described by the respective edge boundaries with respect to the palmar side of the hand, however the region to be protected 102 is to be understood as being similarly shaped on the dorsal side of the hand, and the generally mirrored shape on the dorsal side is not repeated herein for brevity.

Figure 5A:
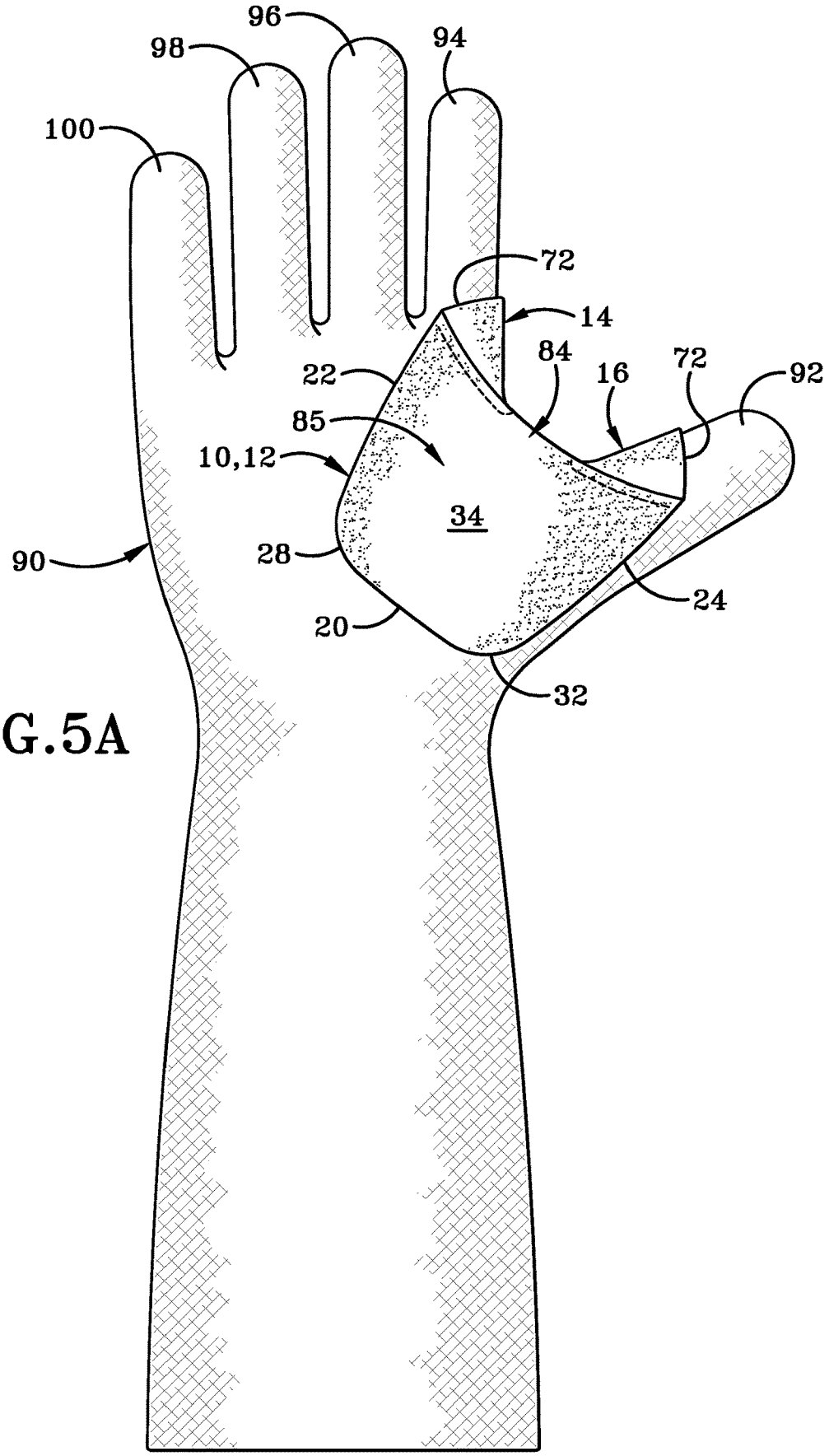
FIG. 5A is a palmar-side view of the protective member attached to the liner.

As depicted in FIG. 5A, the protective member 10 connects with the liner 90 such that the protective member 10 is positioned directly above the region to be protected 102. More particularly, a first protecting region 85 of protective member 10 is positioned to protect at least a portion of the palmar side of the wearer's hand. As such, when the protective member 10 is attached to the liner, certain components are positioned relative to the wearer's hand.

In one implementation, the protective member 10 is connected with the liner in any known chemical manner, mechanical manner, or non-chemical and non-mechanical manner. For example, the protective member 10 may be chemically adhered or bonded with the liner 90, or the protective member 10 may be mechanically fastened with the liner 90.

With the protective member 10 attached to the liner 90, the third edge 22 lies directly above the palmar first edge boundary 106 such that the third edge 22 extends ulnarly above the third metacarpal bone at an angle between 15° and 75°. The corner 28 is positioned closely adjacent to directly above the center of the third metacarpal bone. The second edge 20 extends over the second metacarpal bone aligned with palmar second edge boundary 108. The fourth edge 24 is aligned with palmar third edge boundary 110 such that the fourth edge 24 extends distally above the longitudinal axis of the first metacarpal bone. The edge 72 on the third portion 16 is aligned with the thumb boundary edge 107 above the proximal thumb phalange and proximal relative to the distal thumb phalange and extends 180° around the ulnar-facing side of the longitudinal axis of the thumb sleeve 92. On the other side of the protective member 10, the edge 72 of the second portion 14 is aligned with forefinger boundary edge 105 to extend 180° around the radius-facing side of the forefinger. This alignment positions the protecting region 84 directly above and over the thumb crotch 104 of liner 90.

Figure 5B:
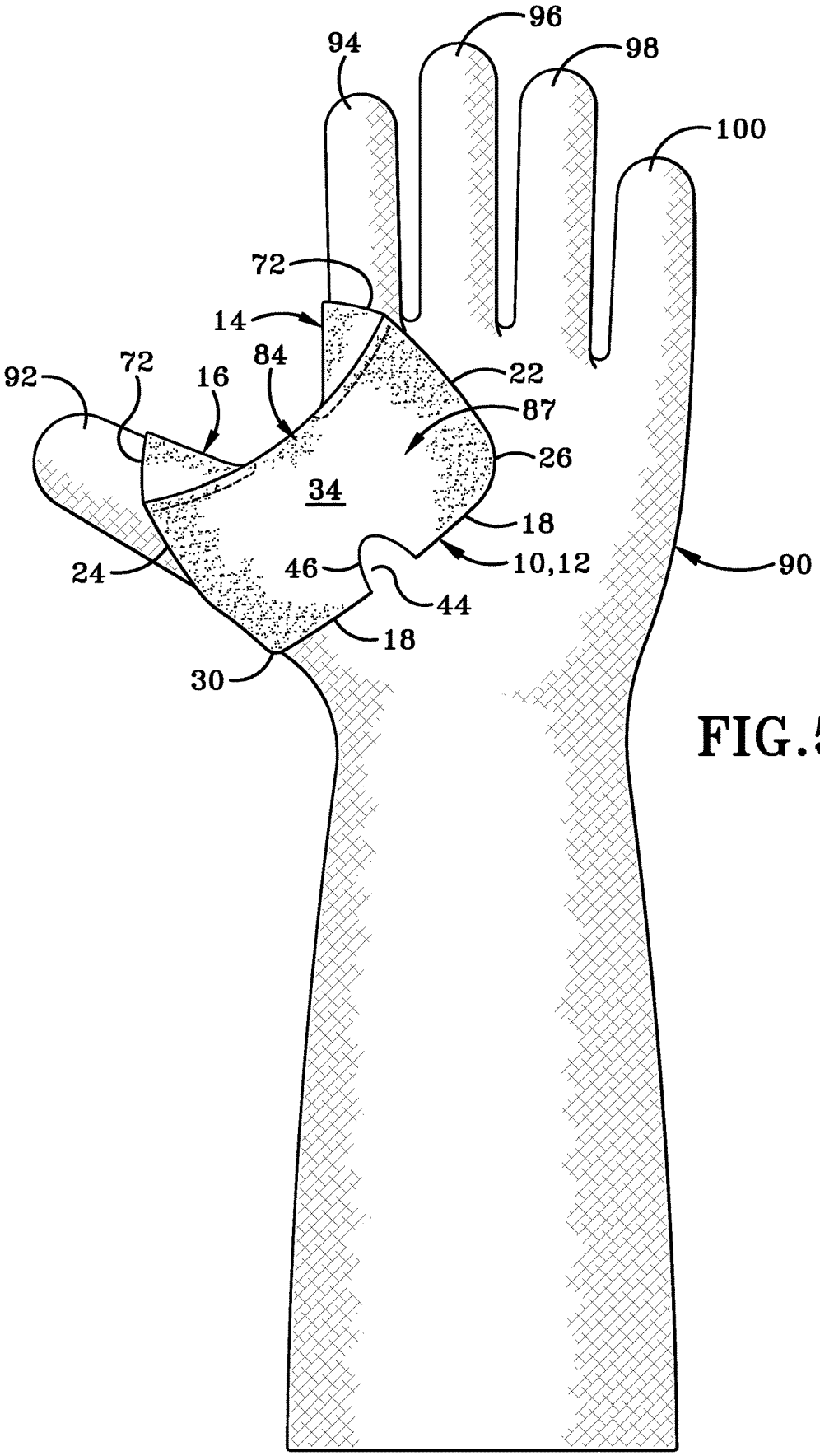
FIG. 5B is a dorsal-side view of the protective member attached to the liner.

As depicted in FIG. 5B, a second protecting region 87 of protective member 10 is positioned to protect at least a portion of the dorsal side of the wearer's hand. Namely, the third edge 22 extends ulnarly at an angle between 15° and 75° crossing over the third metacarpal bone. The first edge 18 extends radially at an angle generally orthogonal to that of the third edge 22. As such, the first edge 18 crosses over the second metacarpal bone at an angle equal to 90° less the angle of the third edge 22. Thus, if the third edge 22 crosses the third metacarpal at about 60° relative to horizontal, then the first edge 18 crosses the second metacarpal at about 30° relative to horizontal.

With respect to the dorsal side, the arcuate edge 46 defining cutout region 44 assists with the flexibility and bending of protective member 10 during its use. As indicated previously in the parent references (from which this is a CIP), the liquid proof and heat resistant glove carrying protective member 10 is preferably used in a delicatessen for removing rotisserie chickens from a rotisserie spit. A deli worker dons these gloves prior to removing the chickens from the spit. To remove a chicken from a spit, a worker wearing the liquid proof heat resistant gloves removes the spit from the rotating oven. The worker then grasps the spit at one end. Ordinarily, a right handed person grasps the right end with his right hand and grasps adjacent the right end of the spit with his left hand in the glove. This spit is then positioned above the thumb-crotch region of the left-hand glove. The user then pulls the spit using his right hand in a motion similar to drawing a sword, all while continuing to grasp the spit with his left hand. As the spit travels over the left-hand thumb crotch region through the user's grasped hand, the chickens are released from the spit and fall into a desired container. The protective member 10 protects the user's hand during this motion.

Figure 6:
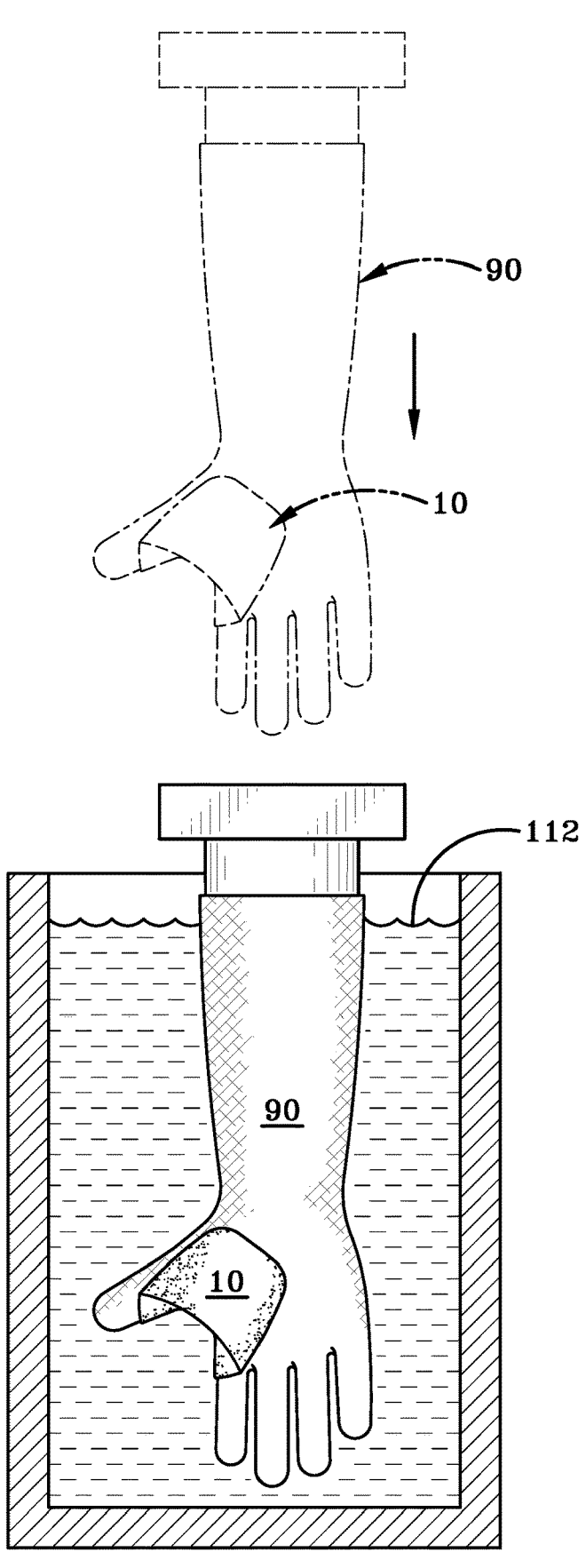
FIG. 6 is an operational view of the liner carrying the protective member being dipped into a bath of liquefied material which cures to form the outer layer of the glove.

FIG. 6 depicts one exemplary method of manufacture for the glove carrying protective member 10. After the protective member 10 has been connected to the liner 90, as described above, the liner may be dipped into a liquefied bath of glove material. This effectively seals the protective member 10 between the liner 90 and an outer surface material layer 112. The outer surface material layer 112 is liquid proof and heat resistant as one having skill in the art would understand, and when cured defines an assembled glove 114.

Figure 7A:
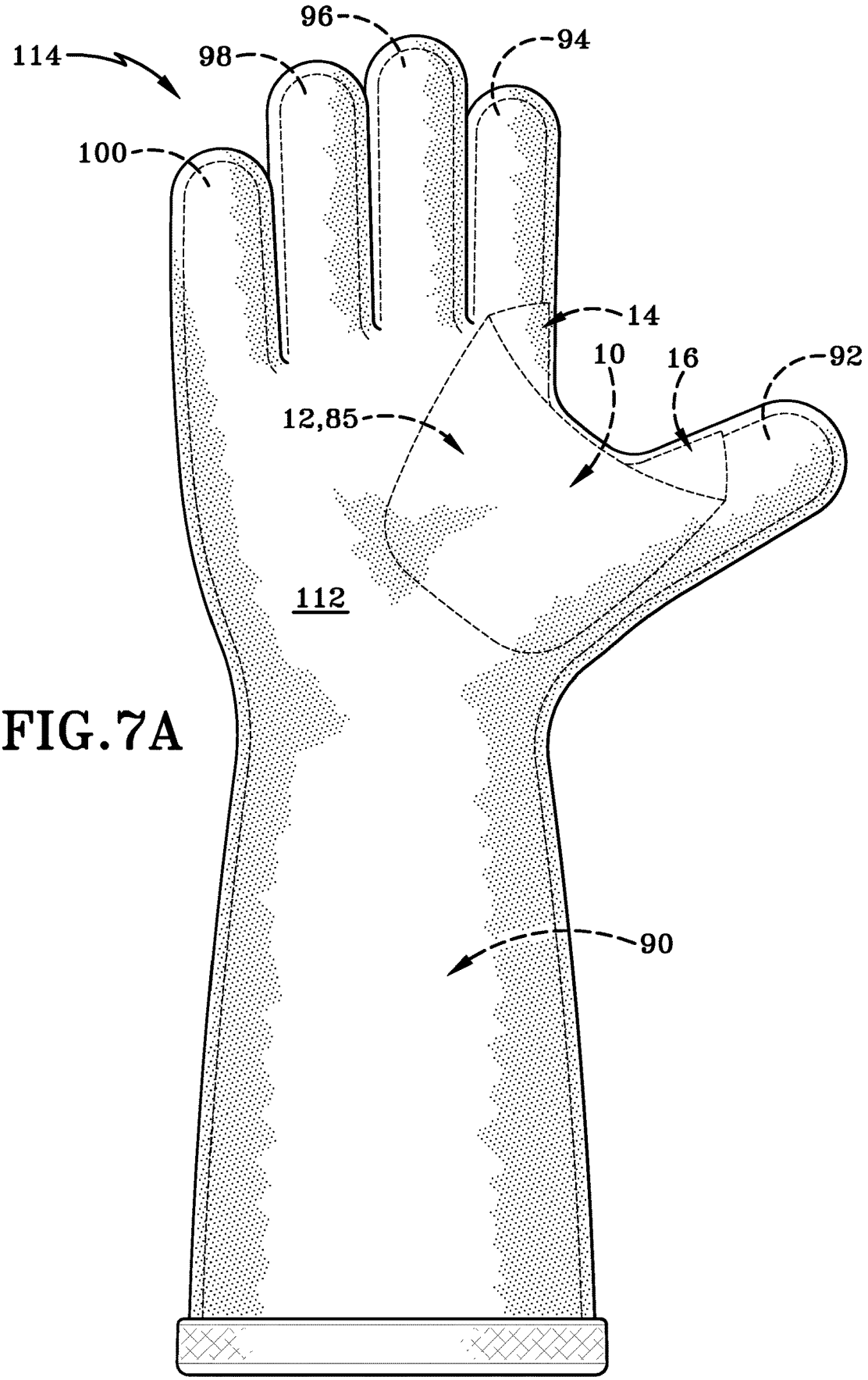
FIG. 7A is a palmar-side view of the assembled liquid proof and heat resistant glove having a protective member extend over and around the thumb crotch of the glove in order to protect the same.
Figure 7B:
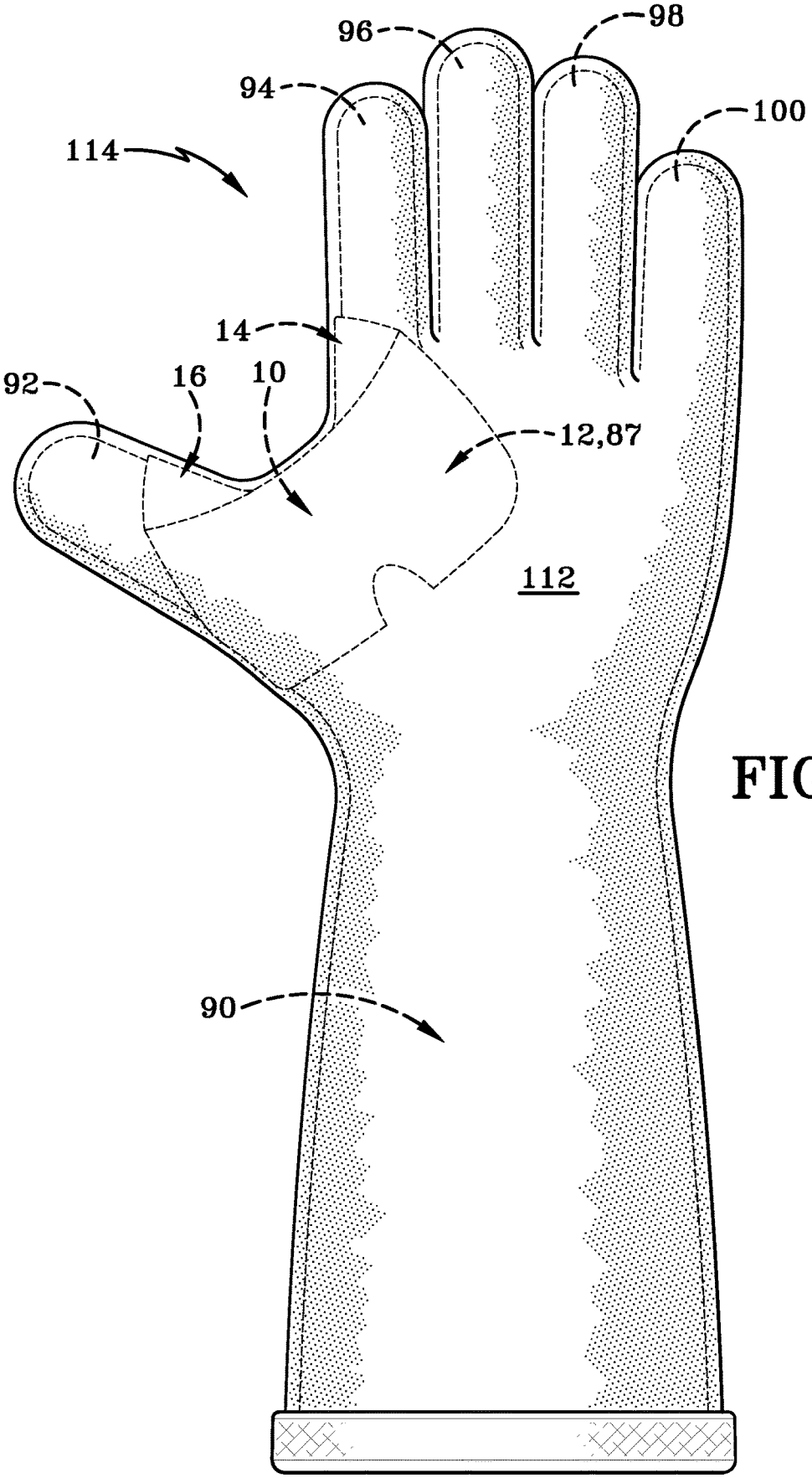
FIG. 7B is a dorsal-side view of the assembled liquid proof and heat resistant glove having a protective member extend over and around the thumb crotch of the glove in order to protect the same.

FIG. 7A and FIG. 7B represent an assembled liquid proof and heat resistant glove 114 in accordance with the present disclosure. The protective member 10 is shown in dashed-lines representing that it is secured and sealed below the outer surface material layer 112 and protects the thumb crotch of the same. However, while protective member 10 is sealed within the glove between the inner liner and the outer surface material 112, it may be visually undetectable.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A liquid proof heat resistance glove comprising:

an inner liner formed in the shape of a glove having a thumb sleeve, a first finger sleeve, a palmar side, and a dorsal side;

an outer layer formed from liquid proof heat resistant material, wherein the outer layer is exterior and entirely covers the thumb sleeve, the first finger sleeve, the palmar side, and the dorsal side, and the outer layer withstanding thermal deformation up to at least 500° F.;

a protected region including a forefinger boundary edge that extends along a portion of the first finger sleeve and extends 180° around a longitudinal axis associated with the first finger sleeve, and the protected region including a thumb boundary edge that extends along a portion of the thumb sleeve and extends 180° around a longitudinal axis associated with the thumb sleeve, and a palmar boundary edge extending along the palmar side between forefinger boundary edge and the thumb boundary edge, and a dorsal boundary edge extending along the dorsal side between the forefinger boundary edge and the thumb boundary edge;

a thumb-crotch region of the glove within the protected region and located between the first finger sleeve and the thumb sleeve, and the thumb crotch region extending from the palmar side to the dorsal side between the first finger sleeve and the thumb sleeve;

a protective member positioned between the inner liner and the outer layer, and the protective member connected to the inner liner and integrally molded with the outer layer located in the protected region and covering the thumb crotch region and not located in other regions of the glove, wherein the protective member includes:

a first surface connected to the inner liner;

a second surface opposite the first surface connected to the outer layer of the glove;

a perimeter edge bounding the first surface and the second surface;

a major axis and a minor axis associated with the first surface, wherein the first surface is longer along the major axis than along the minor axis; and at least one slit interrupting the perimeter edge and the first surface, wherein the at least one slit enables the protective member to bend around one of (a) the thumb sleeve and (b) the first finger sleeve such that the protective member extends over and protects the thumb-crotch region;

wherein the first portion protective member is bent to cover the thumb-crotch region adjacent an inner terminal end of the at least one slit; and wherein the liquid proof heat resistant glove is adapted to be donned and permit a rotisserie spit to be pulled in slicing motion along an outer surface of the glove, and the outer layer and protective member are configured to protect against high temperatures, hot liquids, and sharp objects.

2. The liquid proof heat resistance glove of claim 1, wherein the protective member includes:

wherein the perimeter edge that is longitudinally aligned relative to the major axis;

wherein the at least one slit is aligned substantially parallel to the minor axis;

a terminal end of the at least one slit terminating prior to the major axis;

a length of the slit measured from the edge to the terminal end of the at least one slit, wherein the length is in a range from ½ inch to 3 inches.

3. The liquid proof heat resistance glove of claim 1, wherein the protective member includes:

a second slit on the first portion that is coplanar with the first slit and opposite the at least one slit relative to the major axis, and a terminal end of the second slit terminating the same distance prior to major axis as the first slit.

4. The liquid proof heat resistance glove of claim 1, wherein the perimeter edge of protective member includes:

a first edge spaced apart and parallel to a second edge;

a third edge extending between the first edge and the second edge;

a fourth edge opposite and spaced apart from the third edge and extends between the first edge and the second edge.

5. The liquid proof heat resistance glove of claim 4, wherein the protective member further includes:

a rounded first corner, wherein the third edge meets the first edge at the rounded first corner.

6. The liquid proof heat resistance glove of claim 5, wherein the protective member further includes:

a rounded second corner, wherein the third edge meets the second edge at the rounded second corner.

7. The liquid proof heat resistance glove of claim 6, wherein the protective member further includes:

a rounded third corner, wherein the fourth edge meets the first edge at the rounded third corner.

8. The liquid proof heat resistance glove of claim 7, wherein the protective member further includes:

a rounded fourth corner, wherein the fourth edge meets the second edge at the rounded fourth corner.

9. The liquid proof heat resistance glove of claim 4, wherein the protective member further includes:

wherein the third edge extends between the first edge and the second edge at an angle between 15° and 75° relative to the longitudinal axis of the glove.

10. The liquid proof heat resistance glove of claim 9, wherein the protective member further includes:

wherein the third edge extends perpendicular to the major axis of the protective member and parallel to the minor axis of the protective member.

11. The liquid proof heat resistance glove of claim 10, wherein the protective member further includes:

wherein the first edge extends at an angle generally orthogonal to that of the third edge.

12. A liquid proof heat resistance glove comprising:

an inner liner formed in the shape of a glove having a thumb sleeve, a first finger sleeve, a palmar side, and a dorsal side;

an outer layer formed from liquid proof heat resistant material, wherein the outer layer is exterior and entirely covers the thumb sleeve, the first finger sleeve, the palmar side, and the dorsal side, and the outer layer withstanding thermal deformation up to at least 500° F.;

a protected region including a forefinger boundary edge that extends along a portion of the first firmer sleeve and extends 180° around a longitudinal axis associated with the first finger sleeve, and the protected region including a thumb boundary edge that extends along a portion of the thumb sleeve and extends 180° around a longitudinal axis associated with the thumb sleeve, and a palmar boundary edge extending along the palmar side between forefinger boundary edge and the thumb boundary edge, and a dorsal boundary edge extending along the dorsal side between the forefinger boundary edge and the thumb boundary edge;

a thumb-crotch region of the glove within the protected region and located between the first finger sleeve and the thumb sleeve, and the thumb crotch region extending from the palmar side to the dorsal side between the first finger sleeve and the thumb sleeve;

a protective member positioned between the inner liner and the outer layer, and the protective member connected to the inner liner and the outer layer located in the protected region and covering the thumb crotch region and not located in other regions of the glove, wherein the protective member includes:

a first portion of the protective member including:

a first surface connected to the inner liner;

a second surface opposite the first surface connected to the outer layer of the glove;

a perimeter edge having a first edge spaced apart from a second edge, a third edge extending between the first edge and the second edge, a fourth edge opposite and spaced apart from the third edge and extends between the first edge and the second edge, wherein the first, second, third, and fourth edges bound the first surface and the second surface; wherein the third edge extends between the first edge and the second edge at an angle between 15° and 75° relative to the longitudinal axis of the glove; wherein the third edge extends perpendicular to the major axis of the protective member and parallel to the minor axis of the protective member; wherein the fourth edge extends distally above a longitudinal axis of the thumb sleeve; wherein the first edge extends radially at an angle generally orthogonal to that of the third edge;

a rounded first corner, wherein the third edge meets the first edge at the rounded first corner; a rounded second corner, wherein the third edge meets the second edge at the rounded second corner; a rounded third corner, wherein the fourth edge meets the first edge at the rounded third corner; and a rounded fourth corner, wherein the fourth edge meets the second edge at the rounded fourth corner;

a major axis and a minor axis associated with the first surface, wherein the first surface is longer along the major axis than along the minor axis; and a first slit interrupting the first edge and the first surface, the first slit extending parallel the to the minor axis; wherein the first slit enables the protective member to bend around the first finger sleeve such that the protective member extends over and protects the thumb-crotch region;

a second slit interrupting the second edge and the first surface, the second slit extending parallel the to the minor axis; wherein the second slit enables the protective member to bend around the thumb sleeve such that the protective member extends over and protects the thumb-crotch region;

wherein the perimeter edge is longitudinally aligned relative to the major axis;

inner terminal ends of the first and second slits terminating prior to the major axis;

a length of the first slit measured from an outer end of the first slit to the inner terminal end of the first slit, wherein the length of the first slit is in a range from ½ inch to 3 inches;

a length of the second slit measured from an outer end of the second slit to the inner terminal end of the second slit, wherein the length of the second slit is in a range from ½ inch to 3 inches;

wherein the first portion is bent to cover the thumb-crotch region adjacent an inner terminal end of the first slit;

wherein the protective member further includes:

a second portion that is a first quarter-round shaped member having an arcuate edge, and two perpendicular edges meeting at a point, wherein the first quarter-round shaped member is disposed within the first slit between a first slit edge and a second slit edge of the first slit;

a third portion that is a second quarter-round shaped member having an arcuate edge, and two perpendicular edges meeting at a point, wherein the second quarter-round shaped member is disposed within the second slit between a first slit edge and a second slit edge of the second slit; and wherein the liquid proof heat resistant glove is adapted to be donned and permit a rotisserie spit to be pulled in slicing motion along an outer surface of the glove, and the outer layer and protective member are configured to protect against high temperatures, hot liquids, and sharp objects.

13. A liquid proof heat resistance glove comprising:

an inner liner formed in the shape of a glove having a thumb sleeve, a first finger sleeve, a palmar side, and a dorsal side;

an outer layer formed from liquid proof heat resistant material, wherein the outer layer is exterior and entirely covers the thumb sleeve, the first finger sleeve, the palmar side, and the dorsal side, and the outer layer withstanding thermal deformation up to at least 500° F.;

a protected region including a forefinger boundary edge that extends along a portion of the first finger sleeve and extends 180° around a longitudinal axis associated with the first finger sleeve, and the protected region including a thumb boundary edge that extends along a portion of the thumb sleeve and extends about 180° around a longitudinal axis associated with the thumb sleeve, and a palmar boundary edge extending along the palmar side between forefinger boundary edge and the thumb boundary edge, and a dorsal boundary edge extending along the dorsal side between the forefinger boundary edge and the thumb boundary edge;

a thumb-crotch region of the glove within the protected region and located between the first finger sleeve and the thumb sleeve, and the thumb crotch region extending from the palmar side to the dorsal side between the first finger sleeve and the thumb sleeve;

a protective member positioned between the inner liner and the outer layer, the protective member connected to the inner liner, the protective member integrally molded with the outer layer, the protective member composed of a para-aramid synthetic fiber, the protective member located in the protected region and covering the thumb crotch region, wherein the protective member includes:

a first surface connected to the inner liner;

a second surface opposite the first surface connected to the outer layer of the glove;

a perimeter edge having a first edge spaced apart from a second edge, a third edge extending between the first edge and the second edge, a fourth edge opposite and spaced apart from the third edge and extends between the first edge and the second edge, wherein the first, second, third, and fourth edges bound the first surface and the second surface; wherein the third edge extends between the first edge and the second edge at an angle between 15° and 75° relative to the longitudinal axis of the glove;

a major axis and a minor axis associated with the first surface, wherein the first surface is longer along the major axis than along the minor axis, wherein the perimeter edge is longitudinally aligned relative to the major axis;

a first slit interrupting the first edge and the first surface, the first slit extending parallel the to the minor axis; wherein the first slit enables the protective member to bend around the first finger sleeve such that the protective member extends over and protects the thumb-crotch region;

a second slit interrupting the second edge and the first surface, the second slit extending parallel the to the minor axis; wherein the second slit enables the protective member to bend around the thumb sleeve such that the protective member extends over and protects the thumb-crotch region;

inner terminal ends of the first and second slits terminating prior to the major axis;

a length of the first slit measured from an outer end of the first slit to the inner terminal end of the first slit, wherein the length of the first slit is in a range from ½ inch to 3 inches;

a length of the second slit measured from an outer end of the second slit to the inner terminal end of the second slit, wherein the length of the second slit is in a range from ½ inch to 3 inches;

wherein the protective member is bent to cover the thumb-crotch region adjacent an inner terminal end of the first slit and the second slit; and wherein the liquid proof heat resistant glove is adapted to be donned and permit a rotisserie spit to be pulled in slicing motion along an outer surface of the glove, and the outer layer and protective member are configured to protect against high temperatures, hot liquids, and sharp objects.

* * * * *